US009478380B2

(12) United States Patent
Rojko

(10) Patent No.: US 9,478,380 B2
(45) Date of Patent: Oct. 25, 2016

(54) CIRCUIT BREAKER SHOCK ABSORBER APPARATUS, ASSEMBLIES, AND METHODS OF OPERATION

(75) Inventor: Jan Rojko, Conyers, GA (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 61 days.

(21) Appl. No.: 14/387,252

(22) PCT Filed: May 3, 2012

(86) PCT No.: PCT/US2012/036292

§ 371 (c)(1),
(2), (4) Date: Sep. 24, 2014

(87) PCT Pub. No.: WO2013/165426

PCT Pub. Date: Nov. 7, 2013

(65) Prior Publication Data

US 2015/0077201 A1 Mar. 19, 2015

(51) Int. Cl.
*H01H 3/60* (2006.01)
*H01H 71/02* (2006.01)
(Continued)

(52) U.S. Cl.
CPC ..... *H01H 71/02* (2013.01); *H01H 3/60* (2013.01); *H01H 71/025* (2013.01); *H01H 71/504* (2013.01); *H01H 71/121* (2013.01)

(58) Field of Classification Search
CPC ..... H01H 3/60; H01H 1/50; H01H 1/64; H01H 9/0044; H01H 9/02; H01H 9/0207; H01H 9/0264; H01H 71/00; H01H 71/02; H01H 71/0214; H01H 71/0228; H01H 73/00; H01H 73/02; H01H 73/06; H01H 2009/02; H01H 2009/0278; H01H 2071/00; H01H 2071/02; H01H 2221/062; H01H 2223/00; H01H 2223/044; H01H 13/60
USPC ..... 200/288; 335/23–25, 35–38, 42–46, 16, 335/147, 195, 167, 176
See application file for complete search history.

(56) References Cited

U.S. PATENT DOCUMENTS 2,683,876 A 7/1954 Sullivan
4,527,027 A 7/1985 Link
(Continued)

FOREIGN PATENT DOCUMENTS

CN 2328827 Y 7/1999
CN 201181672 Y 1/2009
DE 1212193 B 3/1966

OTHER PUBLICATIONS

ASTM International, ASTM-Standard Test Method for Rubber Property-Durometer Hardness; Designation: D2240-05; p. 1-13; US.
(Continued)

*Primary Examiner* — Renee Luebke
*Assistant Examiner* — Anthony R. Jimenez
(74) *Attorney, Agent, or Firm* — Harness, Dickey & Pierce, P.L.C.

(57) ABSTRACT

Embodiments disclose a circuit breaker shock absorber apparatus configured to absorb impact due to blow-off of one or more circuit breaker contact arms. The circuit breaker shock absorber apparatus has a base directly or indirectly coupled to a circuit breaker housing and an absorber body comprising a damping material having a tangent delta at 10% strain and 10 Hz and at room temperature of greater than about 0.45, and a durometer of less than about 60 per ASTM D2240 Type A. Circuit breaker shock absorber assemblies and methods of operating the breaker shock absorber assemblies are provided, as are other aspects.

22 Claims, 7 Drawing Sheets

(51) Int. Cl.
*H01H 71/50* (2006.01)
*H01H 71/12* (2006.01)

(56) References Cited

U.S. PATENT DOCUMENTS

| | | | | |
|---|---|---|---|---|
| 4,891,617 | A | 1/1990 | Beatty, Jr. | |
| 5,089,795 | A | 2/1992 | Craft | |
| 7,064,284 | B1 * | 6/2006 | Rakus | H01H 71/504 200/244 |
| 2006/0151307 | A1 | 7/2006 | Pendrick | |

OTHER PUBLICATIONS

ASTM International, US; "Standard Guide for Dynamic Testing of Vulcanized Rubber and Rubber-Linke Materials Using Vibratory Methods"; Designation: D5992-96; p. 1-25.; 2011; US.
ASTM Intern.; "Standard Practice for Rubber-Standard Temperatures for Testing"; Designation: D1349-09; p. 1-2.; 2009; US.
International Search Report and Written Opinion dated Feb. 21, 2013.
Chinese Office Action and English translation dated Dec. 3, 2015.

* cited by examiner

CIRCUIT BREAKER SHOCK ABSORBER APPARATUS, ASSEMBLIES, AND METHODS OF OPERATION

PRIORITY STATEMENT

This application is the national phase under 35 U.S.C. §371 of PCT International Application No. PCT/US2012/036292 which has an International filing date of May 3, 2012, which designated the United States of America, the entire contents of which are hereby incorporated herein by reference.

FIELD

At least one embodiment of the present invention relates generally to circuit breakers for interrupting current from an electrical power supply, and more particularly to circuit breaker shock absorbers.

BACKGROUND

Circuit breakers are used in certain electrical systems for protecting an electrical circuit coupled to an electrical power supply. Such circuit breakers can include ON, OFF, and TRIP configurations. Certain circuit breakers, when tripped can experience magnetic repulsion forces that cause a contact arm carrying a moveable electrical contact to move quite violently. Prior art circuit breakers have included shock absorber elements to somewhat reduce the severity of end impacts. However, existing absorber apparatus are deficient for a number of reasons.

Accordingly, circuit breakers including improved shock absorbers are desired.

SUMMARY

In a first embodiment, a circuit breaker shock absorber apparatus is provided. The circuit breaker shock absorber apparatus includes a circuit breaker housing, a shock absorber coupled to the circuit breaker housing, the shock absorber having a base coupled to the circuit breaker housing, and an absorber body comprising a damping material having a tangent delta at 10% strain and 10 Hz and at room temperature of greater than about 0.45, and a durometer of less than about 60 per ASTM D2240 Type A.

In a second embodiment, a circuit breaker shock absorber assembly is provided. The circuit breaker shock absorber assembly includes a circuit breaker housing including a mounting portion and a supporting wall, a side pole shock absorber having a base coupled to the mounting portion, an absorber body supported by the supporting wall, the absorber body comprising an inner core portion of a damping elastomer material having a tangent delta at 10% strain and 10 Hz and at room temperature of greater than about 0.45 and a durometer of less than about 60 per ASTM D2240 Type A, and one or more moveable contact arms configured and operable to contact the side pole shock absorber.

According to another embodiment, a circuit breaker shock absorber assembly is provided. The circuit breaker shock absorber assembly includes a circuit breaker housing, a frame having spaced apart first and second frame portions, a center pole shock absorber having a base coupled to the frame portions, an absorber body comprising a core portion of a damping elastomer material having a tangent delta at 10% strain and 10 Hz and at room temperature of greater than about 0.45, and a durometer of less than about 60 per ASTM D2240 Type A, and one or more moveable contact arms configured and operable to contact the center pole shock absorber.

According to another embodiment, a circuit breaker shock absorber assembly is provided. The circuit breaker shock absorber assembly includes a circuit breaker housing including at least two pole regions, a frame having spaced apart first and second frame portions coupled to the housing at one of the at least two pole regions, a center pole shock absorber having a center base portion coupled to the first and second frame portions, a center absorber body comprising a center core portion of a damping material having a tangent delta at 10% strain and 10 Hz and at room temperature of greater than about 0.45 and a durometer of less than about 60 per ASTM D2240 Type A, and at least one side pole shock absorber having a base portion coupled to a mounting wall of the circuit breaker housing, a side absorber body comprising an side core portion of a damping elastomer material having a tangent delta at 10% strain and 10 Hz and at room temperature of greater than about 0.45 and a durometer of less than about 60 per ASTM D2240 Type A, and one or more moveable contact arms provided at the at least two pole regions and operable to contact the center pole shock absorber and the at least one side pole shock absorber.

According to another embodiment, a circuit breaker shock absorber subassembly is provided. The subassembly includes a frame having spaced apart first and second frame portions, and a center pole shock absorber having a base coupled to the frame portions, an absorber body comprising a core portion of a damping elastomer material having a tangent delta at 10% strain and 10 Hz and at room temperature of greater than about 0.45, and a durometer of less than about 60 per ASTM D2240 Type A.

According to another embodiment, a method of operating a circuit breaker shock absorber assembly is provided. The method includes providing a circuit breaker housing, providing a shock absorber coupled to the circuit breaker housing, the shock absorber having a base coupled to the circuit breaker housing and an absorber body comprising a damping material having a tangent delta at 10% and 10 Hz and at room temperature of greater than about 0.45, and a Shore A of less than about 60, and absorbing kinetic energy of one or more moveable contact arms by contact with the shock absorber.

BRIEF DESCRIPTION OF THE DRAWINGS

Still other embodiments, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DETAILED DESCRIPTION OF THE EXAMPLE EMBODIMENTS

Figure 1:
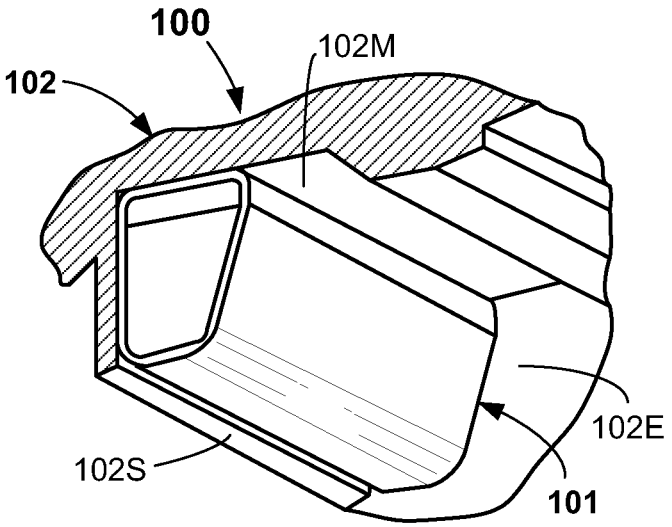
FIG. 1 illustrates a partially cross-sectioned isometric view of a circuit breaker shock absorber assembly adapted for a circuit breaker side pole according to embodiments.

Certain conventional circuit breakers may have a propensity upon encountering a short circuit event for the electrical contacts to blow apart under tremendous force. This causes the one or more contact arms to rapidly rotate. At the end of their rotational excursions, they may make contact with a portion of the circuit breaker housing. In order to absorb impact and limit damage to the circuit breaker housing, prior art circuit breakers have included shock absorbers that are contacted by the contact arms in an attempt to absorb the impact of the blow of the one or more contact arms. However, existing shock absorber designs have been less than effective.

In particular, some designs do not act directly upon the contact arms but on a cross bar, for example. Thus, damping is not applied directly to the moving contact arm, thereby imparting stresses to other system components. In other systems, the contact arm contacts a barrier and a thin layer of an absorbing material is provided on the back of the insulating barrier. In such systems, because the layer thickness is so thin, or because the layer is not contacted directly by the contact arm, effective damping may not be achieved. Other systems use mechanical springs (e.g., coil springs). However, such systems do not provide effective damping. In other systems, the absorber material may be destroyed by the intense heat generated during such contact arm blow off events.

In view of the above shortcomings, according to one or more embodiments, a circuit breaker shock absorber assembly including one or more shock absorber apparatus is provided. The shock absorber apparatus is configured and adapted to absorb impacts by one or more moveable contact arms of a circuit breaker. The shock absorber apparatus is coupled to a circuit breaker housing either directly or through an intermediate member such as a rigid frame including first and second frame portions.

The shock absorber apparatus has a base portion adapted to be coupled to the circuit breaker housing and an absorber body comprising a damping material having a tangent delta of greater than about 0.45, and a durometer of less than about 60 per ASTM D2240 Type A. Accordingly, critical or near damping of the motion of one or more contact arms may be achieved. Embodiments having a core portion of the damping material and an elastomer skin of a second elastomer material different from the damping material are disclosed. The second elastomer material may be a heat resistant material, which protects the relatively resilient, yet relatively highly-damped core material from the high temperatures being generated at contact separation in the circuit breaker.

In another broad aspect of an embodiment, a method of operating a circuit breaker shock absorber assembly is provided. The method includes providing a circuit breaker housing, providing a shock absorber coupled to the circuit breaker housing, the shock absorber having a base portion coupled to the circuit breaker housing and an absorber body comprising a damping material having a tangent delta of greater than about 0.45, and a durometer of less than about 60 per ASTM D2240 Type A, and absorbing kinetic energy of one or more moveable contact arms by contact with the shock absorber.

These and other embodiments of circuit breaker shock absorber apparatus, circuit breaker shock absorber assemblies, and methods of operating circuit breaker shock absorber assemblies are described below with reference to FIGS. 1-8. The drawings are not necessarily drawn to scale. Like numerals are used throughout the specification to denote like elements.

Figure 2A:
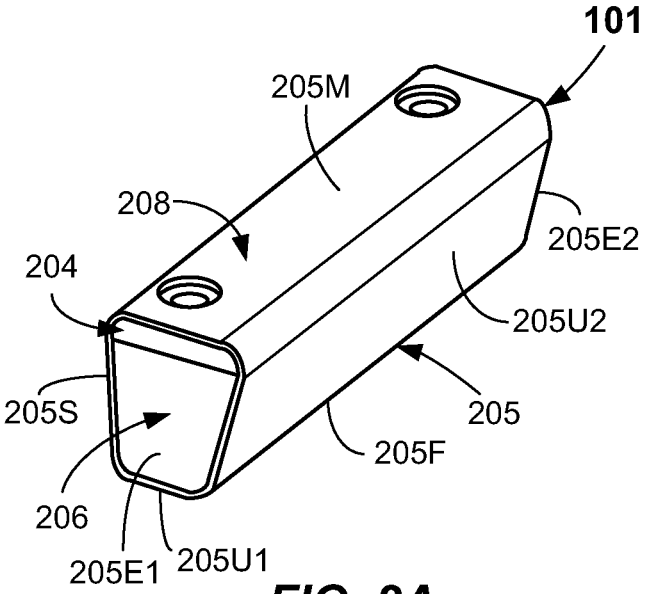
FIG. 2A illustrates an isometric view of a circuit breaker shock absorber apparatus according to embodiments.
Figure 2B:
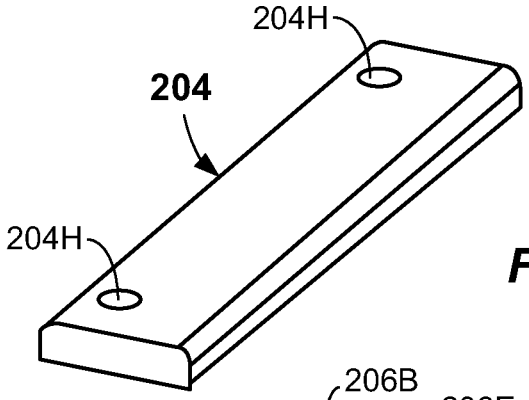
FIGS. 2B-2D illustrate isometric views of various components of a circuit breaker shock absorber apparatus of FIG. 2A according to embodiments.
Figure 2C:
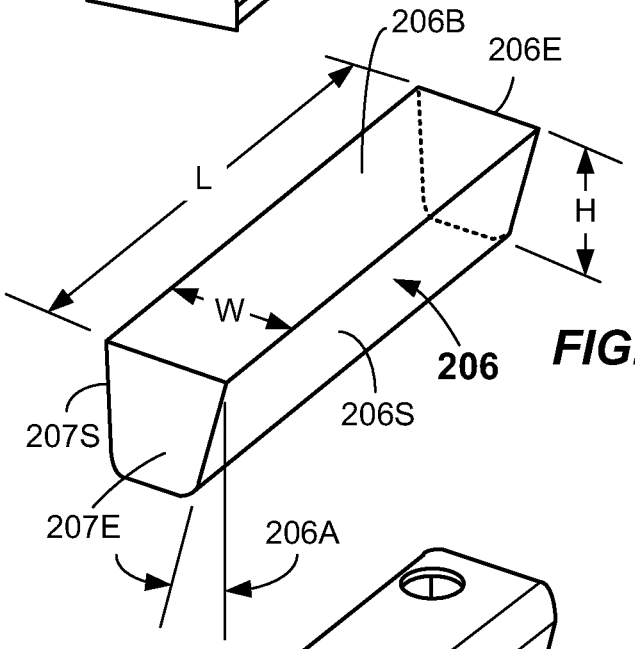
Figure 2D:
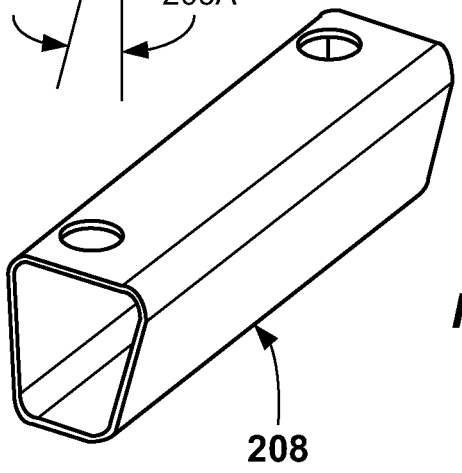

Referring now in specific detail to FIGS. 1-2D, a circuit breaker shock absorber assembly 100 including a circuit breaker shock absorber apparatus 101 and its various components are illustrated. Various configurations of the circuit breaker shock absorber apparatus 101 are shown to enable understanding of the operation thereof. The circuit breaker shock absorber assembly 100 will be referred to herein as a "circuit breaker shock absorber assembly," or "shock absorber assembly," or simply "absorber assembly." The circuit breaker shock absorber apparatus 101 will be referred to herein as a "circuit breaker shock absorber apparatus," "shock absorber apparatus," or simply "shock absorber." The shock absorber assembly 100 includes utility, features, and functions adapted to absorb blow-off impact forces of one or more contact arms in a circuit breaker into which it is installed. Circuit breaker is meant to include any device that is configured and adapted to protect an electrical circuit by having one or more contact arms that blow off upon being tripped.

Referring again to FIGS. 1-2D, the shock absorber assembly 100 includes the circuit breaker shock absorber apparatus 101 coupled to a circuit breaker housing 102. Only a portion of the housing 102 that interfaces with the shock absorber 101 is shown in FIG. 1. The remainder of the housing 102 may be of conventional construction. The shock absorber apparatus 101 shown in FIG. 1-2D is a side pole shock absorber, and may be coupled directly to the circuit breaker housing 102. In other embodiments, such as the center pole embodiment shown in FIG. 3A, the shock absorber apparatus 301 may be coupled indirectly to the housing 102 through attachment to another intermediate component, such as a frame of a contact assembly comprising frame portions installed in the circuit breaker housing 102, 602 (See FIGS. 5 and 6A-6B).

In the depicted embodiment of FIG. 1-2D, the shock absorber 101 comprises a base portion 204 that is coupled to the circuit breaker housing 102 and an absorber body 205 comprising a relatively resilient, yet relatively highly-damped, damping material. The base portion 204 is adapted to couple the shock absorber 101 to the circuit breaker housing 102. The damping material may be a relatively highly-damped material exhibiting a damping coefficient (tangent delta) of greater than about 0.45, and a relatively resilient material having a durometer of less than about 60 per ASTM D2240 Type A.

Tangent delta as used throughout herein is defined and measured in dynamic shear at 10% strain and at 10 Hz and at room temperature and per ASTM D5992-96(2011) entitled "Standard Guide for Dynamic Testing of Vulcanized Rubber and Rubber-Like Materials Using Vibratory Methods." Tangent delta is also sometimes referred to as "loss factor." Durometer as used herein means durometer per ASTM D2240, Type A.

In some embodiments, the core portion 206 may have a durometer of less than about 60 per ASTM D2240 Type A, or even a durometer of less than about 40 per ASTM D2240 Type A. In some embodiments, the core portion 206 may have a durometer between about 20 and about 60 per ASTM D2240 Type A, or even a durometer between about 40 and about 60 per ASTM D2240 Type A. Moreover, in some embodiments, the core portion 206 may exhibit a tangent delta in shear of greater than about 0.45 at 10% strain and at 10 Hz and at room temperature, or even a tangent delta in shear of greater than about 0.6 at 10% strain and at 10 Hz and at room temperature. In one or more other embodiments, the core portion 206 may exhibit a tangent delta in shear of between about 0.45 and about 0.70 in shear at 10% strain and at 10 Hz and at room temperature, or even between about 0.45 and about 0.60 in shear at 10% strain and at 10 Hz and at room temperature. In the core portion 206, the damping material may comprise a highly-damped elastomer such as polyurethane, fluorosilicone, or silicone, vinyl thermoplastic, styrene-isoprene-styrene block copolymer, or the like for example. A poly-ether based polyurethane may also be used for the core portion 206, such as SORBOTHANE available from Sorbothane, Incorporated of Kent, Ohio. Other suitable high-damped resilient materials such as bromo butyl rubber, may be used.

The base 204, as shown in FIG. 2B, may comprise a relatively thin rigid material, such as steel. Optionally, the base 204 may include a zinc coating. Other materials and coatings may be used. The base 204 may have a thickness of between about 3 mm and about 3.5 mm, a width of between about 15 mm and about 16 mm, and a length of between about 42 mm and about 47 mm. Other dimensions may be used. The base 204 may include one or more threaded holes 204H for allowing the shock absorber 101 to be coupled to the shock absorber housing 102 by one or more fasteners (e.g., screws—See FIG. 4).

In the depicted embodiment shown in FIG. 2A, the absorber body 205 may be made up of two different elastomer materials. In particular, the depicted shock absorber apparatus 101 comprises a core portion 206 of the damping material described above, and an elastomer skin 208 of a second elastomer material that is different from the damping material of the core portion 206.

In one or more embodiments, the elastomer skin 208, as shown in FIG. 2D, may be manufactured from a high temperature resistant material having a heat resistance that is greater than the material of the core portion 206. Thus, the skin 208 forms a heat protective jacket over the core portion 206. For example, the elastomer skin 208 may have a continuous dry heat rating of greater than about 340 Deg F. per ASTM D1349-09 entitled "Standard Practice for Rubber-Standard Temperatures for Testing," or even between about 340 Deg F. to about 600 Deg F. per ASTM D1349-09. The use of a high temperature resistant material may prevent burning of the absorber body 205 due to the high heat and electrical arcing generated from contact separation during tripping events. For example, the elastomer skin 208 may be manufactured from a thermoplastic elastomer material, such as a thermoplastic vulcanizate material of polypropylene and ethylene propylene diene monomer (EPDM) such as Santoprene™. Alternatively, the elastomer skin 208 may be made from a copolymer of tetrafluoroethylene and propylene (TFE/P) such as AFLAS®, silicone, fluorocarbon, or fluoropolymer material. In one or more embodiments, the elastomer skin 208 may be made of a relatively stiff material exhibiting a durometer of greater than about 70 per ASTM D2240 Type A. Furthermore, in one or more embodiments, the elastomer skin 208 may have a thickness of less than about 3 mm. Other thicknesses may be used. In the depicted embodiment, the elastomer skin 208 is applied to the core portion 206 and the base 204. For example, the elastomer skin 208 may be formed by molding or an extruding process. The elastomer skin 208 may cover the outer surfaces of the shock absorber 101, but not the ends, as shown. Optionally, the ends of the shock absorber 101 may also be covered with the elastomer skin 208.

In more detail, the core portion 206, as shown in FIG. 2C, may have a base surface 206B located proximate to the base 204, and first and second sidewalls 206S, 207S extending (e.g., downwardly, as shown) from the base surface 206B. The first and second sidewalls 206S, 207S may comprise non-parallel surfaces. One surface 207S may be formed at approximately a right angle to the base surface 206B, and the other surface 206S may be formed at an angle 206A from a plane perpendicular to the base surface 206B. The angle 206A may be between about 15 degrees and about 18 degrees. Other angles may be used. End surfaces 206E, 207E may be formed at approximately right angles to the base surface 206B. The core portion 206 may have a height H of between about 12 mm and about 16 mm, for example. Core portion 206 may have a width W of between about 10 mm and about 12 mm, for example. A length L of the core portion 206 may be between about 40 mm and about 45 mm, for example. Other height H, width W, and length L values may be used.

Referring again to FIGS. 1 and 2A, the shock absorber body 205 comprises a mounting face 205M that is adapted to contact and be coupled to a mounting portion 102M. The mounting portion 102M may be a flat surface of the circuit breaker housing 102. The absorber body 205 may have a supported side face 205S that is adapted to contact a supporting wall 102S of the circuit breaker housing 102, at least upon contact events when the one or more contact arms (406—FIG. 4) contact the shock absorber 101 during a tripping event. Thus, the shock absorber 101 may include two supported faces that may be supported substantially completely, namely the mounting face 205M supported by the base 204 and the supported side face 205S supported by the supporting wall 102S. The absorber body 205 may have at least two unsupported faces, such as a first unsupported surface 205U1, and a second unsupported surface 205U2 intersecting at a free edge 205F.

Figure 4:
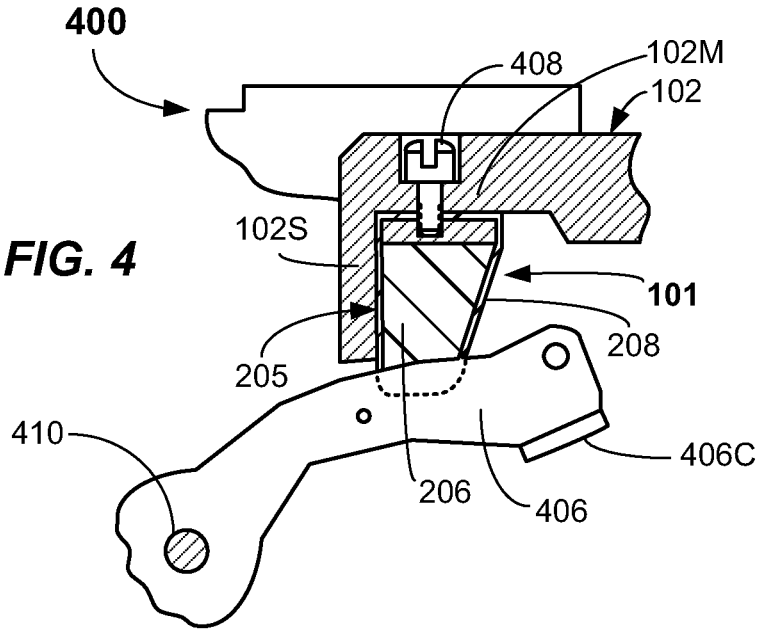
FIG. 4 illustrates a cross-sectioned side view of a circuit breaker shock absorber assembly of a side pole of a circuit breaker according to embodiments.

In some embodiments, the first unsupported surface 205U1, second unsupported surface 205U2, and free edge 205F are positioned, configured, and adapted to be contacted by the one or more moveable contact arms (See FIG. 4). The supported side face 205S of the shock absorber body 205, as installed in the housing 102, may be supported along its length by the supporting wall 102S (FIG. 1) of the circuit breaker housing 102. Likewise, one or more of the end surfaces 205E1, 205E2 may be supported along their width by an end wall support of the circuit breaker housing 102 (See FIG. 7).

Figure 3A:
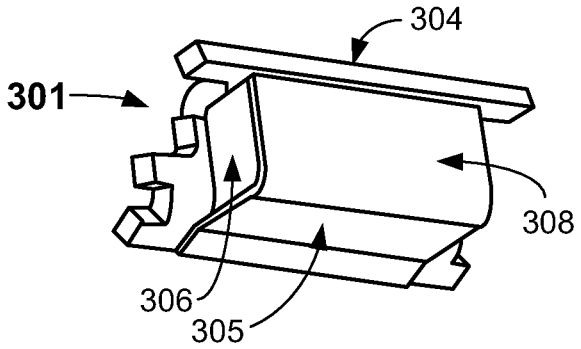
FIG. 3A illustrates an isometric view of circuit breaker shock absorber apparatus adapted for a circuit breaker center pole according to other embodiments.
Figure 3B:
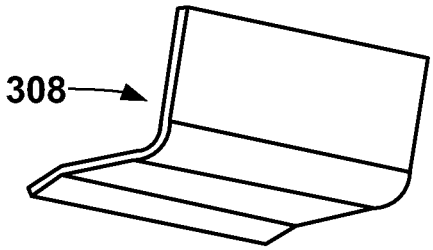
FIGS. 3B-3D illustrate isometric views of various components of a circuit breaker shock absorber apparatus of FIG. 3A according to embodiments.
Figure 3C:
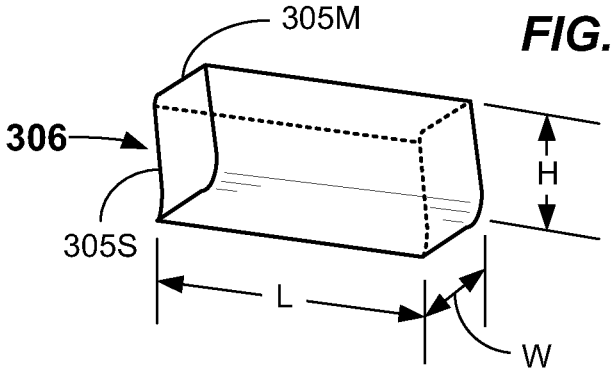
Figure 3D:
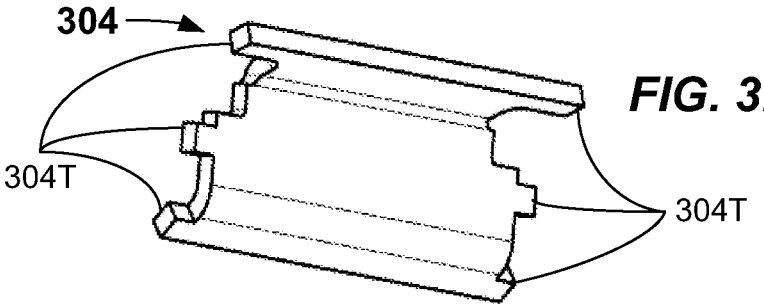

Another embodiment of a shock absorber apparatus 301 is shown in FIG. 3A. This shock absorber apparatus 301 is adapted for use in a center pole of a circuit breaker. Its various components are shown in FIG. 3B-3D. As in the previous embodiment, the shock absorber 301 includes a base 304 adapted to be coupled to the circuit breaker housing 102 and an absorber body 305 comprising a core portion 306 having a damping material having a tangent delta of greater than about 0.45, and a durometer of less than about 60 per ASTM D2240 Type A. In some embodiments, the core portion 306 exhibits a durometer between about 40 and about 60 per ASTM D2240 Type A. Moreover, in some embodiments, the core portion 306 exhibits a tangent delta of between about 0.45 and about 0.60 in shear at 10% strain and at 10 Hz and at room temperature. The core portion 306 may have a height H of between about 12 mm and about 16 mm, for example. Core portion 306 may have a width W of between about 10 mm and about 12 mm, for example. A length L of the core portion 306 may be between about 42 mm and about 48 mm, for example. Other values may be used.

The absorber body 305 may be coupled to the base 304, such as by bonding with an adhesive (e.g., cold or hot set adhesive), for example. The absorber body 305 may, as in the previous embodiment, be supported on two sides. For example, the supported sides may include a mounting face 205M and a supported side face 205S. Each of the mounting face 205M and the supported side face 205S may be bonded to the base 304.

Covering a first unsupported face 305U1 and a second unsupported face 305U2 may be an elastomer skin 308. The elastomer skin 308 may be manufactured from the materials specified above and may have the properties as described above. The elastomer skin 308 may be bonded to the first unsupported face 305U1 and a second unsupported face 305U2. The elastomer skin 308 may also be bonded to a portion of the base 304.

In this embodiment, the base 304 includes a non-planar configuration and has tabs 304T on either end, as shown in FIG. 3D. The tabs 304T are adapted to couple to respective first and second frame portions of a frame that in turn connects to the circuit breaker housing 102 (See FIGS. 5 and 6). Thus, the shock absorber 301 is coupled to the circuit breaker housing 102 by the first and second frame portions, and the tabs 304T of the base 304 are inserted into apertures in the first and second frame portions, as will be apparent from the following.

A side pole circuit breaker shock absorber assembly 400, which may be adapted for use in a side pole of a circuit breaker, is shown in FIG. 4. The shock absorber assembly 400 includes a circuit breaker housing 102 and the shock absorber 101 as previously described. As previously described, the circuit breaker housing 102 includes a mounting portion 102M and a supporting wall 102S. In the depicted embodiment, the absorber body 205 is supported by the supporting wall 102S and the shock absorber 101 is coupled to the mounting portion 102M by one or more fasteners 408. The shock absorber 101 may be a side pole shock absorber, and the shock absorber assembly 400 includes one or more contact arms 406 (only a portion shown) configured and operable to contact the shock absorber 101. Contact arm 406 carries a moveable electrical contact 406C and pivots about a contact arm pivot 410. In some embodiments, the contact arm 406 may comprise fingers that contact the shock absorber 101. In FIG. 4, the contact arm 406 is shown contacting and deforming the absorber body 205 thus the kinetic energy of the moving arm 406 is absorbed by the absorber 101. The static spring constant of the shock absorber 101 in the depicted embodiment may be less than about 200 lbf/in (35,000 N/m), and between about 200 lbf/in (35,000 N/m) and about 100 lbf/in (17,500 N/m) in some embodiments. Other spring constants may be used. The elastomer skin 208 may protect the core portion 206 from heat, arcing, and debris generated from the tripping events separating the electrical contacts.

Figure 5:
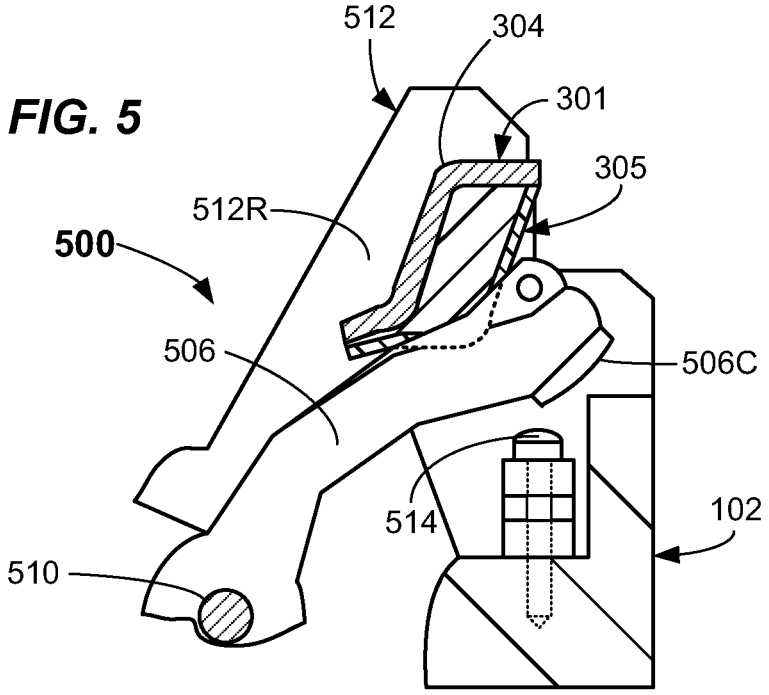
FIG. 5 illustrates a cross-sectioned side view of a circuit breaker shock absorber assembly of a center pole of a circuit breaker according to embodiments.

FIG. 5 illustrates a circuit breaker shock absorber assembly 500. The shock absorber 301 may be a center pole circuit breaker shock absorber, which may be adapted for use in a center pole of a circuit breaker. The shock absorber assembly 500 includes a circuit breaker housing 102 and the shock absorber 301 having an absorber body 305 and a base 304 as previously described. The shock absorber assembly 500 includes one or more contact arms 506 (only a portion shown) configured and operable to contact the shock absorber 301 and to absorb energy upon blow off of the contact arm 506 due to tripping events. The one or more contact arms 506 each carries a moveable electrical contact 506C and pivots about a contact arm pivot 510.

Figure 7:
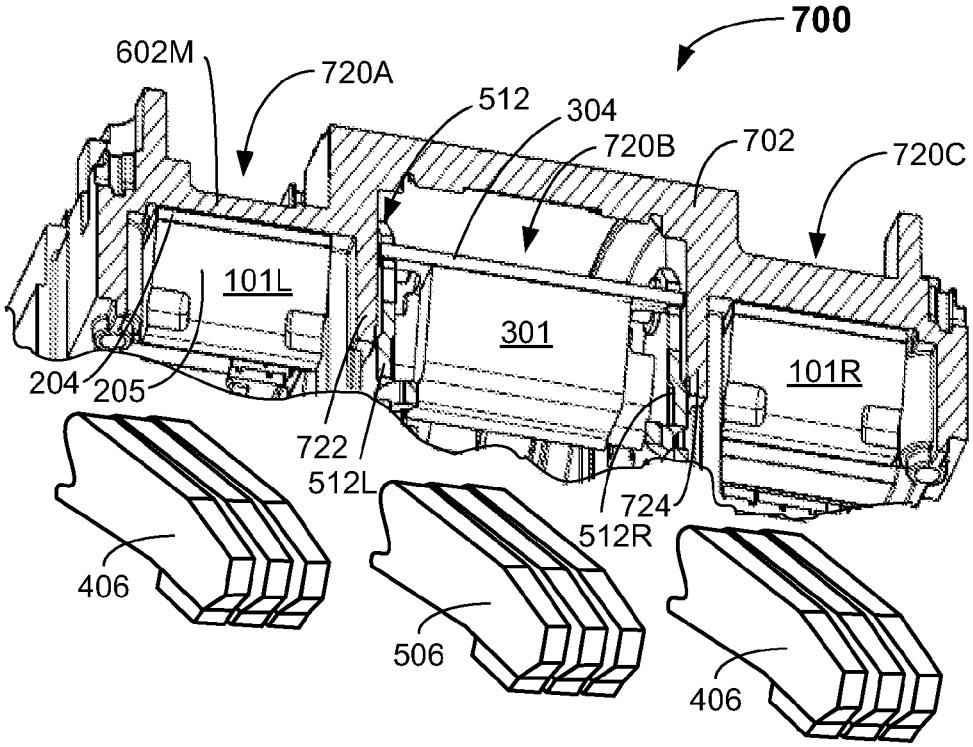
FIG. 7 illustrates an isometric underside view of a portion of a circuit breaker shock absorber assembly having both a center pole and side pole shock absorbers according to embodiments.

The shock absorber assembly 500 includes a frame 512 coupled to the circuit breaker housing 102, such as by one or more fasteners 514. The frame 512 may include first and second frame portions 512R, 512L as shown in FIG. 7 (only the right frame portion 512R is shown in FIG. 5). The frame 512 comprising frame portions 512L, 512R may be made from any suitable rigid material, such as stamped steel. Other materials may be used. Furthermore, other numbers of frame portions and constructions of the frame 102 may be used.

Figure 6A:
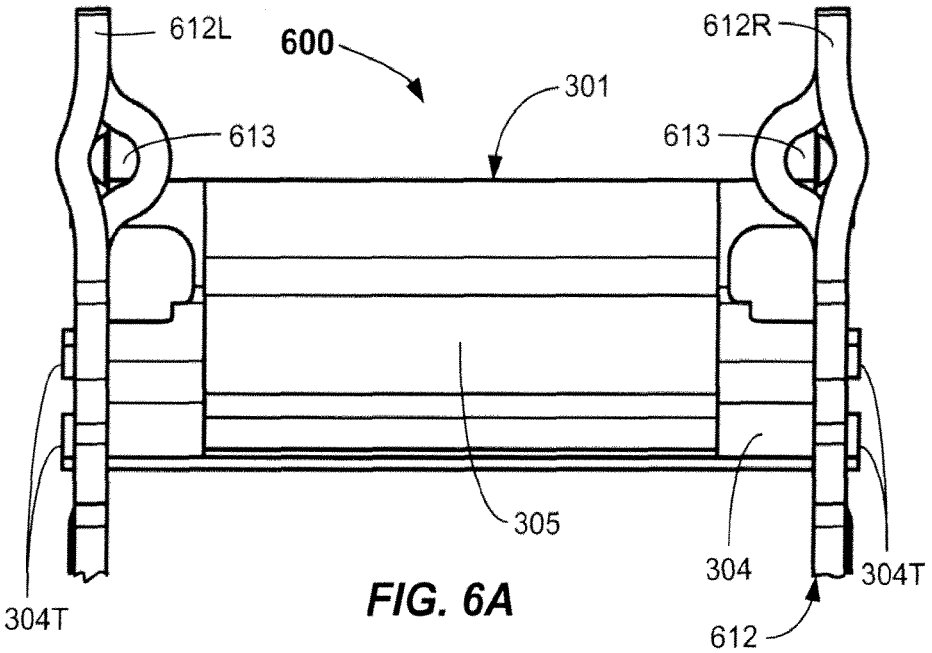
FIG. 6A illustrates a underside view of a circuit breaker shock absorber subassembly of a center pole of a circuit breaker according to embodiments.
Figure 6B:
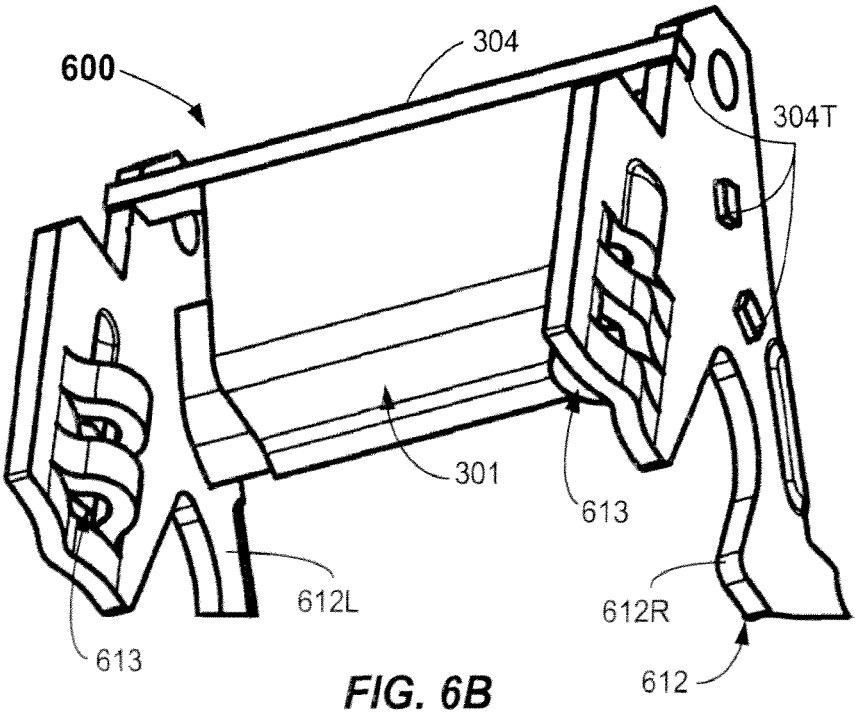
FIG. 6B illustrates an isometric view of a circuit breaker shock absorber subassembly of a center pole of a circuit breaker according to embodiments.

FIG. 6A-6B illustrates an embodiment of circuit breaker shock absorber subassembly 600, which may be adapted for use with a center pole of a circuit breaker. The shock absorber subassembly 600 includes a center pole shock absorber 301 having an absorber body 305 and a base 304 as previously described. The shock absorber subassembly 600 is configured and operable to absorb energy upon blow off of a contact arm of a center pole (not shown) due to tripping events. The shock absorber subassembly 600 includes a frame 612 having spaced apart first and second frame portions 612L, 612R which is adapted to be coupled to a circuit breaker housing (not shown), such as by one or more fasteners passing through fastener passages 613 and secured to the circuit breaker housing. The frame portions 612L, 612R may be made from any suitable rigid material, such as stamped steel. Other materials may be used. The base 304 is coupled to the frame portions 612L, 612R. For example, tabs 304T of the base 304 may be received in holes and/or slots formed in the frame portions 612L, 612R. Some or all of the tabs 304T may be riveted to secure the center pole shock absorber 301 into the frame 612. The center pole shock absorber 301 may comprising a core portion of a damping elastomer material having a tangent delta, in shear, at 10% strain and 10 Hz and at room temperature of greater than about 0.45, and a durometer of less than about 60 per ASTM D2240 Type A.

FIG. 7 illustrates a circuit breaker shock absorber assembly 700 including at least two pole regions such as first side pole 720A, and center pole 720B, and including three pole regions (pole regions 720A, 720B, and another side pole 720C) as shown. The shock absorber assembly 700 further comprises a circuit breaker housing 702 including the at least two pole regions 720A, 720B, and three as shown. Pole region as used herein is a region including a single phase of electricity (e.g., A phase, B phase, C phase, or the like). The various pole regions 720A, 720B, 720C may include first and second walls 722, 724 that operate to separate the electrical phases. A frame 512 having spaced apart first and second frame portions 512L, 512R coupled to the circuit breaker housing 702 at one of the at least two pole regions, and in particular, the center pole region 720B. A center shock absorber 301 is coupled to the frame portions 512L, 512R. The center pole shock absorber 301 has a center base 304 coupled to the first and second frame portions 512L, 512R, such as by receiving tabs 304T in apertures and/or slots formed in the frames 512L, 512R. Tabs 304T may be deformed or riveted in place. The center pole shock absorber 301 includes a center absorber body 305 that may have the absorber properties of tan delta and durometer as described above.

The shock absorber assembly 700 further includes at least one side pole shock absorber 101L. The side pole shock absorber 101 has a base 204 coupled to a mounting wall 602M of the circuit breaker housing 602, and a side absorber body 205 as described above. The shock absorbers 101L, 101R may be as described above. One or more moveable contact arms 406, 506 are provided at the at least two pole regions 720A, 720B and operable to contact the center pole shock absorber 301 and the at least one side pole shock absorber 101L. One or more moveable contact arms 406 may also be provided at the pole region 720C and operable to contact the side pole shock absorber 101R in the depicted embodiment. Any combination of center pole and side pole absorbers of the constructions described herein may be used. Center pole absorber as used herein means the absorber located at a pole containing the tripping mechanism, which may be centered in some embodiments. Other combinations of shock absorbers may be used, such as a center pole absorber and three side pole absorbers (two on one side and one on the other side of the center pole shock absorber).

Figure 8:
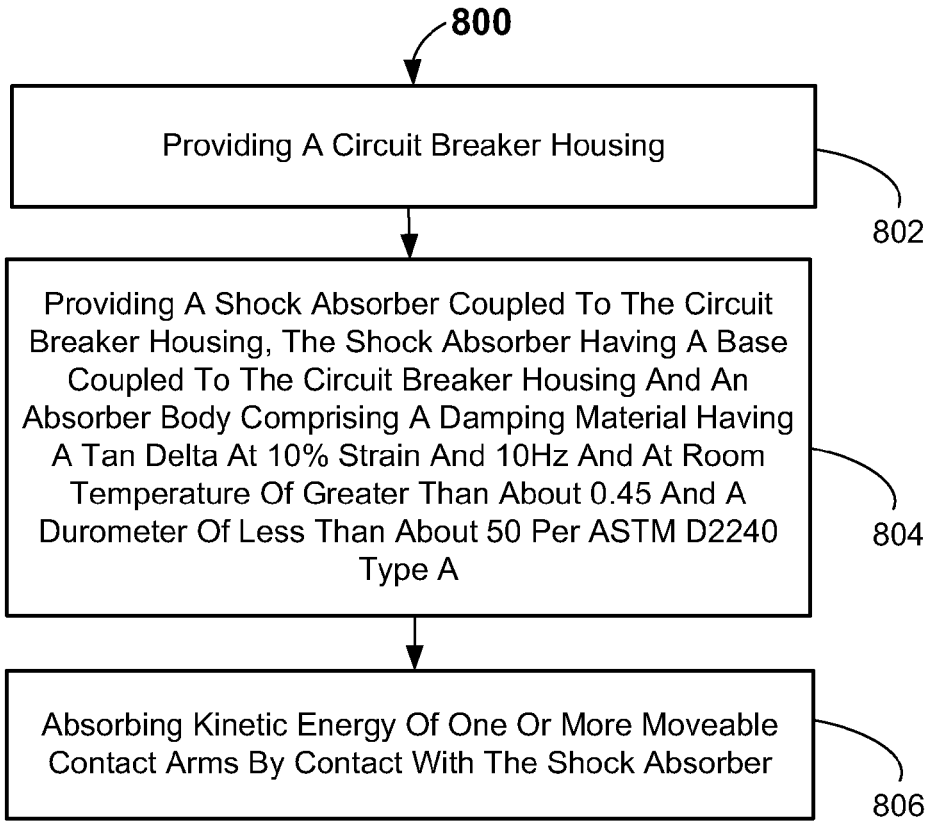
FIG. 8 illustrates a flowchart of a method of operating a circuit breaker shock absorber assembly according to embodiments.

FIG. 8 is a flowchart illustrating a method 800 of operating a circuit breaker shock absorber assembly (e.g., circuit breaker shock absorber assembly 100, 400, 500) according to one or more embodiments. The method 800 includes providing a circuit breaker housing (e.g., 102) in 802. The method 800 includes, in 804, providing a shock absorber apparatus (e.g., 101, 301) coupled to the circuit breaker housing (e.g., 102), the shock absorber apparatus having a base (e.g., 204, 304) coupled to the circuit breaker housing (e.g., 102) and an absorber body (e.g., 205, 305) comprising a damping material having a tangent delta at 10% strain and 10 Hz and at room temperature of greater than about 0.45, and a durometer of less than about 60 per ASTM D2240 Type A, and, in 806, absorbing kinetic energy of one or more moveable contact arms (e.g., 406, 506) by contact with the shock absorber apparatus (e.g., 101, 301). The method 800 may be used to absorb shocks of the one or more contact arms (e.g., 406, 506) for both one or more side poles and/or a center pole in a circuit breaker, and in circuit breakers including both side and center poles, as shown in FIG. 7. The shock absorber apparatus (e.g., 101, 301) may provide critical or near critical damping of the motion of the one or more contact arms (e.g., 406, 506).

While the invention is susceptible to various modifications and alternative forms, specific embodiments and methods thereof have been shown by way of example in the drawings and are described in detail herein. It should be understood, however, that it is not intended to limit the invention to the particular apparatus, assemblies, or methods disclosed, but, to the contrary, the intention is to cover all modifications, equivalents, and alternatives falling within the scope of the invention.

What is claimed is:

1. A circuit breaker shock absorber apparatus, comprising:

a circuit breaker housing; and a shock absorber coupled to the circuit breaker housing, the shock absorber including a base coupled to the circuit breaker housing and removably coupled to an absorber body comprising a damping material including a tangent delta at 10% strain and 10 Hz and at room temperature of greater than about 0.45, and a durometer of less than about 60 per ASTM D2240 Type A.

2. The shock absorber apparatus of claim 1, wherein the absorber body comprises two different elastomer materials.

3. The shock absorber apparatus of claim 2, further comprising:

a core portion of the damping material; and an elastomer skin of a second elastomer material different from the damping material, the core portion being enclosed by the elastomer skin on at least two sides of the core portion.

4. The shock absorber apparatus of claim 3, wherein the elastomer skin comprises a material selected from the group consisting of a thermoplastic vulcanizate material of polypropylene and ethylene propylene diene monomer (EPDM), a copolymer of tetrafluoroethylene and propylene (TFE/P), silicone, fluorocarbon, and fluoropolymer.

5. The shock absorber apparatus of claim 3, wherein the elastomer skin comprises a durometer of greater than about 70 per ASTM D2240 Type A.

6. The shock absorber apparatus of claim 3, wherein the elastomer skin comprises a thickness of less than about 3 mm.

7. The shock absorber apparatus of claim 1, wherein the damping material comprises a durometer of between about 20 and about 60 per ASTM D2240 Type A.

8. The shock absorber apparatus of claim 7, wherein the damping material comprises a durometer of between about 40 and about 60 per ASTM D2240 Type A.

9. The shock absorber apparatus of claim 1, wherein the damping material comprises a tangent delta at 10% strain and 10 Hz and at room temperature of between about 0.45 and about 0.70.

10. The shock absorber apparatus of claim 1, wherein the damping material comprises a tangent delta at 10% strain and 10 Hz and at room temperature of between about 0.45 and about 0.60.

11. The shock absorber apparatus of claim 1, wherein the damping material comprises bromo butyl rubber.

12. The shock absorber apparatus of claim 1, wherein the absorber body comprises a core portion including a base surface adjacent to the base, and first and second sidewalls extending from the base surface, the first and second sidewalls comprising non-parallel surfaces.

13. The shock absorber apparatus of claim 1, wherein the absorber body comprises a mounting face, a supported side face, and at least two unsupported faces intersecting at a free edge.

14. The shock absorber apparatus of claim 1, further comprising:

first and second frame portions, the shock absorber being coupled to the circuit breaker housing by the first and second frame portions, and the base includes tabs inserted into the first and second frame portions.

15. A circuit breaker shock absorber assembly, comprising:

a circuit breaker housing including a mounting portion and a supporting wall;

a side pole shock absorber including a base plate coupled to the mounting portion and to an absorber body, the absorber body being supported by the supporting wall, the absorber body comprising an inner core portion of a damping elastomer material including a tangent delta at 10% strain and 10 Hz and at room temperature of greater than about 0.45 and a durometer of less than about 60 per ASTM D2240 Type A; and one or more moveable contact arms configured and operable to contact the side pole shock absorber.

16. A circuit breaker shock absorber assembly, comprising:

a circuit breaker housing;

a frame including spaced apart first and second frame portions;

a center pole shock absorber including a base coupled to the frame portions, and an absorber body coupled to the base, the absorber body comprising a core portion of a damping elastomer material including a tangent delta at 10% strain and 10 Hz and at room temperature of greater than about 0.45, and a durometer of less than about 60 per ASTM D2240 Type A; and one or more moveable contact arms configured and operable to contact the center pole shock absorber.

17. A circuit breaker shock absorber assembly, comprising:

a circuit breaker housing including at least two pole regions;

a frame including spaced apart first and second frame portions coupled to the housing at one of the at least two pole regions;

a center shock absorber including a center base coupled to the first and second frame portions, a center absorber body coupled to the base, the center absorber body comprising a center core portion of a damping material including a tangent delta at 10% strain and 10 Hz and at room temperature of greater than about 0.45 and a durometer of less than about 60 per ASTM D2240 Type A;

at least one side pole shock absorber including a side base coupled to a mounting wall of the circuit breaker housing, and a side absorber body comprising an side core portion of a damping elastomer material including a tangent delta at 10% strain and 10 Hz and at room temperature of greater than about 0.45 and a durometer of less than about 60 per ASTM D2240Type A; and one or more moveable contact arms provided at the at least two pole regions and operable to contact the center pole shock absorber and the at least one side pole shock absorber.

18. A circuit breaker shock absorber subassembly, comprising:

a frame including spaced apart first and second frame portions; and a center pole shock absorber including a base coupled to the frame portions, and an absorber body coupled to the base, the absorber body comprising a core portion of a damping elastomer material including a tangent delta at 10% strain and 10 Hz and at room temperature of greater than about 0.45, and a durometer of less than about 60 per ASTM D2240 Type A.

19. A method of operating a breaker shock absorber assembly, comprising:

providing a circuit breaker housing;

providing a shock absorber coupled to the circuit breaker housing, the shock absorber including a base coupled to the circuit breaker housing and an absorber body coupled to the base, the absorber body comprising a damping material including a tangent delta at 10% strain and 10 Hz and at room temperature of greater than about 0.45 and a durometer of less than about 60 per ASTM D2240 Type A; and absorbing kinetic energy of one or more moveable contact arms by contact with the shock absorber.

20. The method of claim 19, further comprising:

contacting an elastomer skin of the shock absorber, the elastomer skin being manufactured from an elastomer material including a durometer of greater than about 70 per ASTM D2240 Type A.

21. The method of claim 19, further comprising:

contacting an elastomer skin of the shock absorber, the elastomer skin being manufactured from a second elastomer material including a continuous dry heat rating of greater than about 340° F. that prevents burning of an absorber body covered by the elastomer skin.

22. The method of claim 19, further comprising:

providing the shock absorber with a mounting face, a supported side face, and at least two unsupported faces intersecting at a free edge; and contacting at least the free edge with the one or more moveable contact arms.

* * * * *